US005845455A

United States Patent [19]

Johnson, III

[11] Patent Number: 5,845,455

[45] Date of Patent: Dec. 8, 1998

[54] MORTAR COLLECTING DEVICE FOR PROTECTING WEEP-HOLES IN MASONRY WALLS

[75] Inventor: Ralph O. Johnson, III, Charlotte, N.C.

[73] Assignee: Masonry Reinforcing Corporation of America, Charlotte, N.C.

[21] Appl. No.: 5,447

[22] Filed: Jan. 12, 1998

[51] Int. Cl.[6] ..... E04B 1/38

[52] U.S. Cl. ..... 52/713; 52/302.6; 52/379; 52/426; 52/508; 52/562

[58] Field of Search ..... 52/713, 714, 562, 52/508, 410, 426, 428, 302.6, 379, 383, 310

[56] References Cited

U.S. PATENT DOCUMENTS

| | | | |
|---|---|---|---|
| 1,746,816 | 2/1930 | Boes . | |
| 1,772,088 | 8/1930 | Sallop | 52/713 |
| 1,954,730 | 4/1934 | Erickson . | |
| 2,147,035 | 2/1939 | Henderson . | |
| 2,298,319 | 10/1942 | Vatet . | |
| 2,329,585 | 9/1943 | Brewer . | |
| 2,705,887 | 4/1955 | Xanten . | |
| 3,277,626 | 10/1966 | Brynjolfsson et al. | 52/713 |
| 3,287,866 | 11/1966 | Bevilacqua . | |
| 3,293,810 | 12/1966 | Cox et al. . | |
| 3,668,829 | 6/1972 | Nelson . | |
| 3,788,017 | 1/1974 | Bachus . | |
| 3,852,925 | 12/1974 | Gazzo . | |
| 4,282,691 | 8/1981 | Risdon . | |
| 4,333,281 | 6/1982 | Scarfone . | |
| 4,381,630 | 5/1983 | Koester . | |
| 4,486,986 | 12/1984 | Cosenza . | |
| 4,598,518 | 7/1986 | Hohmann | 52/714 X |
| 4,612,742 | 9/1986 | Bevilacqua . | |
| 4,827,684 | 5/1989 | Allan | 52/378 |
| 4,852,320 | 8/1989 | Ballantyne . | |
| 4,875,319 | 10/1989 | Hohmann | 52/508 X |
| 4,907,385 | 3/1990 | Biodrowski . | |
| 4,910,931 | 3/1990 | Pardue, Jr. . | |
| 5,207,043 | 5/1993 | McGee et al. | 52/379 |
| 5,230,189 | 7/1993 | Sourlis . | |
| 5,343,661 | 9/1994 | Sourlis . | |
| 5,598,673 | 2/1997 | Atkins . | |
| 5,634,310 | 6/1997 | Hohmann . | |

OTHER PUBLICATIONS

Polytite Manufacturing Corporation, "Polytite masonry accessories", complete brochure, 1997.

Masonry Reinforcing Corporation of America, Products Catalogue, pp. 2–15, 1997.

*Primary Examiner*—Robert Canfield

*Attorney, Agent, or Firm*—Adams Law Firm, P.A.

[57] ABSTRACT

A mortar collecting device for being positioned in a cavity between first and second spaced-apart walls, such as masonry walls, and including an anchor for being embedded in a mortar joint of the first masonry wall, a first attachment device carried by the anchor for being positioned in the cavity between the first and second masonry walls, a U-shaped bracket for being positioned at least partially in the cavity between the first and second masonry walls, second attachment device is carried by the bracket and cooperating with the first attachment device of the anchor for supporting the bracket, and a shield for being carried and supported by the bracket in the cavity between the masonry walls. The shield comprises a deformable elongate sheet for being positioned on the bracket in the cavity and extending along a predetermined length of the cavity in contact with both of the masonry walls to prevent mortar from accumulating in the bottom of the cavity and blocking weep-holes formed in at least one of the masonry walls, and first and second spaced-apart elongate openings formed in the sheet and defining therebetween an elongate web, the bracket for being positioned through the openings with the sheet supporting the bracket on one side thereof and the web supporting the bracket on an opposing side thereof.

10 Claims, 4 Drawing Sheets

MORTAR COLLECTING DEVICE FOR PROTECTING WEEP-HOLES IN MASONRY WALLS

TECHNICAL FIELD AND BACKGROUND OF THE INVENTION

This invention relates to a mortar collecting device for protecting weep-holes in masonry walls. Generally, exterior masonry wall surfaces for buildings are constructed together with a structural inner wall which serves as the main supporting wall. The inner structural wall is usually formed of either a frame wall of wood or steel studs, with an inner surface of drywall or some interior finish; concrete blocks spaced apart from the exterior masonry wall, or a concrete shear wall constructed according to a wall construction technique commonly known as cavity wall construction. Between the exterior masonry wall and the inner structural wall there generally exists an air space, or cavity, which may be partially filled with insulation.

Weep-holes are located at spaced intervals along the lower course of each floor level of an exterior masonry wall in order to allow air flow between the exterior and interior cavity. These weep-holes serve a dual purpose. First, the weep-holes equalize the air pressure on both sides of the masonry wall (i.e., the exterior and interior masonry wall surfaces) by allowing air to pass therethrough. Secondly, weep-holes allow moisture which may have condensed on the inner masonry wall surfaces and trickled down to the lower brick row level to flow through the weep-hole to the outside of the masonry wall. This prevents entrapment of moisture in the cavity immediately adjacent the inner wall surface of the exterior masonry wall and prevents moisture accumulation and damage to any insulation located in the cavity adjacent the inner structural wall.

Should moisture be allowed to remain on the inner wall surface of the exterior masonry wall, it may seep to the exterior surface of the masonry wall from the interior wall surface through the masonry bricks. This is very undesirable, since the evaporating moisture from the exterior surface of the brick leaves behind deposited minerals, causing unsightly "whitening" of the exterior masonry wall surface in a process called efflorescence.

In addition, the moisture accumulation in the exterior wall may at some point freeze, causing cracks in the masonry wall due to the force of expansion of the frozen water. This can cause structural instability in the wall with obvious, negative consequences.

The problems of efflorescence, moisture seepage through the masonry wall, and frost cracking, have commonly been overcome by proper ventilation of the cavity with the use of weep-holes along the bottom row surface of the masonry wall.

However, as excess mortar used in cementing masonry bricks together is extruded from between such mortar joints during construction, it falls within the cavity space to the lower level where the weep-holes are located. This excess mortar piles up at the base of the masonry wall in the interior cavity where the weep-holes are located, causing the weep-holes to become plugged.

This situation is highly undesirable, for the reasons mentioned above, but in addition because increased amounts of moisture may begin to accumulate at the bottom of the cavity, being unable to escape to the exterior because of the plugged weep-holes. Although galvanized metal flashing is usually provided along the bottom surface of the outer masonry wall, accumulated moisture may then seep through seams in the flashing and through the insulation and into the inner structural wall.

Building contractors and architects have recognized this problem, and some techniques and products have been used in an attempt to deal with the situation.

One early method involved placing a removable trowel, or mortar-collecting device, along the bottom row on the interior side of the masonry wall under construction, to which ropes were attached. During construction of the masonry wall, any extruded mortar fell onto the mortar-collecting device. After each day's work, and upon the wall being completed, the device containing extruded mortar is pulled up from the interior cavity by means of the ropes, removing the excess mortar from the cavity. See U.S. Pat. No. 2,705,887.

Recently, however, building codes have begun to require that reinforcing devices be provided to allow the outer masonry wall to be tied to the interior structural wall. These reinforcing devices may have inwardly protruding ties, frequently in the form of closed loop members fabricated from 3/16" diameter steel wire, which would prevent the prior art trowel with the accumulated mortar on it from being removed from the interior cavity.

Another practice employed in the industry involves use of a series of corrugated water-resistant members placed adjacent and overlying the inner surface of the masonry wall. These corrugated members are placed between horizontal rows of protruding closed loop ties along the wall and are pressed against the wall surface by, for example, insulation within the inner cavity. See U.S. Pat. No. 3,293,810.

These corrugated members are partially effective in preventing excess extruded mortar from falling to the base level row of bricks, and thus prevent plugging of the weep-holes. However, the primary purposes of such devices is to increase the insulation capability of the wall by trapping air pockets along the horizontal corrugations, and provide a waterproof barrier to prevent insulation from contacting a moist inner wall surface of the masonry wall upon which moisture may have condensed. Such corrugated members pose a problem in that they also prevent moisture which condenses on the interior wall surface from trickling downwardly to the weep-holes. This allows the moisture to collect within the wall cavity. Thus, the problems of moisture seepage to the exterior masonry wall surface, efflorescence and frost cracking, described above, still exist. Moreover, the quantity of material necessary to cover the inner wall surface is costly.

Another attempt to resolve this problem is shown in U.S. Pat. Nos. 5,230,189 and 5,343,661. This device comprises a tangled web of plastic filaments shaped to fit in the cavity between the inner and outer walls. The material is porous enough to allow air and moisture through, but resilient enough to catch and retain mortar on its top surfaces. The side walls of the device are undercut to provide air and moisture flow paths even with a very large accumulation of mortar.

U.S. Pat. No. 4,852,320 discloses a length of corrugated plastic which is positioned in the cavity above each weep-hole. The upper surface is sloped towards each end enough to allow water to run off, but is shallow enough to retain any mortar falling onto it. However, the devices shown in the '320 patent do not extend across the cavity from the inner to the outer wall, but reside against and protect only against mortar oozing from the mortar joint down the inner wall. Mortar which may fall from the wall as it is applied to the topmost course of blocks or bricks may fall away from the inner wall into the area not protected by the device disclosed in the '320 Patent.

SUMMARY OF THE INVENTION

Therefore, it is an object of the invention to provide a mortar collecting device for being positioned in a cavity between first and second spaced-apart masonry walls.

It is another object of the invention to provide a mortar collecting device which prevents accumulation of mortar in the bottom of the cavity between first and second spaced-apart masonry walls.

It is another object of the invention to provide a mortar collecting device which prevents accumulation of water in the bottom of the cavity between first and second spaced-apart masonry walls.

It is another object of the invention to provide a mortar collecting device which is easily assembled and installed.

It is another object of the invention to provide a mortar collecting device which is adjustable within a relatively wide range to fit in wall cavities of varying widths.

It is another object of the invention to provide a mortar collecting device which extends across substantially the entire width of the wall cavity.

It is another object of the invention to provide a mortar collecting device which includes means for draining water from the surface of the device.

It is another object of the invention to provide a mortar collecting device which is inexpensive, lightweight, and utilizes some components which are also utilized for other related purposes.

It is another object of the invention to provide a mortar collecting device which also functions as a tie between the inner and outer masonry walls.

It is another object of the invention to provide a mortar collecting device which works in conjunction with widely accepted double hook-and-eye wall reinforcing systems.

These and other objects of the present invention are achieved in the preferred embodiments disclosed below by providing a mortar collecting device for being positioned in a cavity between first and second spaced-apart walls wherein one of the walls is a masonry wall. The device comprises an anchor for being attached to the first wall, a first attachment means carried by the anchor for being positioned in the cavity between the first and second walls, a bracket for being positioned at least partially in the cavity between the first and second walls, second attachment means carried by the bracket and cooperating with the first attachment means of the anchor for supporting the bracket, and a shield for being carried and supported by the bracket in the cavity between the walls. The shield comprises a deformable elongate sheet for being positioned on the bracket in the cavity and extending along a predetermined length of the cavity in contact with both of the walls to prevent mortar from accumulating in the bottom of the cavity and blocking weep-holes formed in at least one of the walls. First and second spaced-apart elongate openings are formed in the sheet and define therebetween an elongate web. The bracket is positioned through the openings with the sheet supporting the bracket on one side thereof and the web supporting the bracket on an opposing side thereof.

According to one preferred embodiment of the invention, the anchor comprises a length of wire formed in a shape having both a lengthwise and widthwise dimension for being locked into the mortar joint.

According to another preferred embodiment of the invention, the first attachment means comprises at least one eyelet formed by a bend in the anchor.

According to yet another preferred embodiment of the invention, the bracket comprises a length of wire.

According to yet another preferred embodiment of the invention, the second attachment means comprises an elongate hook for being positioned into the eyelet.

Preferably, the shield is fabricated of a plastic material.

According to yet another preferred embodiment of the invention, the shield includes a crease extending along the length of the shield for permitting the shield to be deformed under pressure against one of the masonry walls.

According to another preferred embodiment of the invention, a mortar collecting device is provided wherein the anchor comprises a U-shaped length of wire having a pair of elongate arms spaced-apart by a bridging arch member, the first attachment means comprises first and second eyelets formed on respective first and second free ends of the arms of the anchor, and the bracket includes first and second hooks defined by first and second bracket arms spaced-apart by a bracket arch member for being received in the eyelets of the anchor, and the hooks are formed to extend generally downwardly when received in the eyelets.

Preferably, the bracket arch member extends at substantially right angles to and diverges from the hooks.

BRIEF DESCRIPTION OF THE DRAWINGS

Some of the objects of the invention have been set forth above. Other objects and advantages of the invention will appear as the invention proceeds when taken in conjunction with the following drawings, in which.

DESCRIPTION OF THE PREFERRED EMBODIMENT AND BEST MODE

Figure 1:
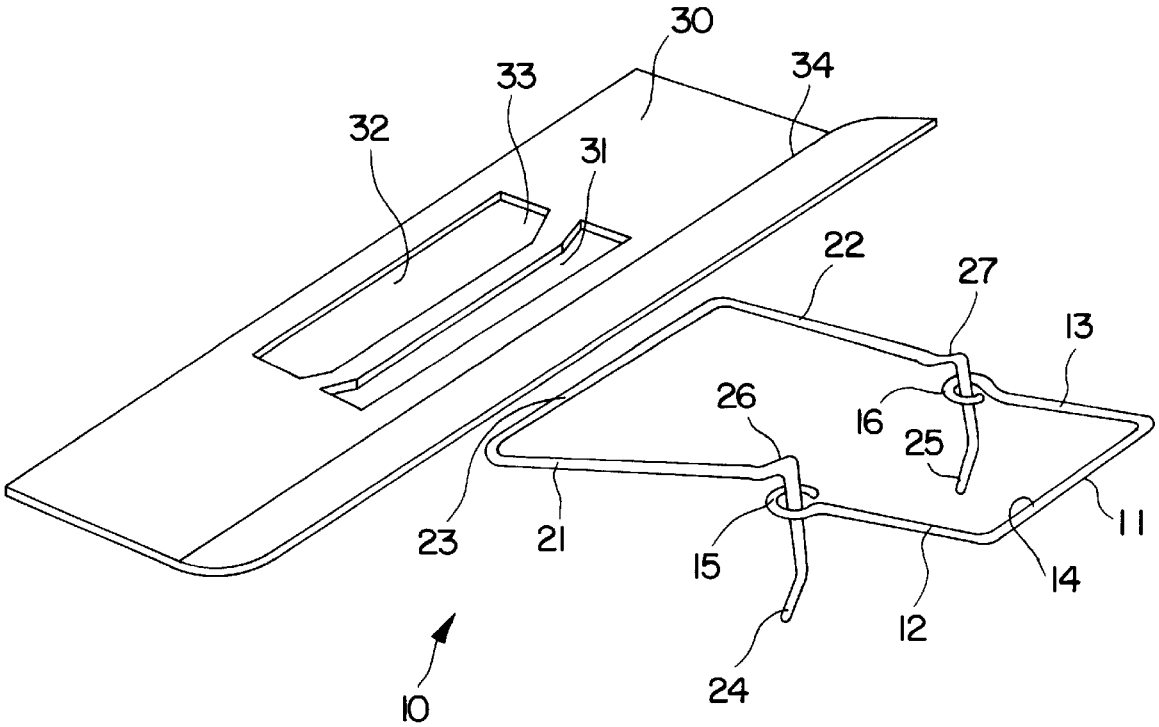
FIG. 1 is an exploded, perspective view of the mortar collecting device according to an embodiment the invention.

Referring now specifically to the drawings, a mortar collecting device according to the present invention is illustrated in FIG. 1 and shown generally at reference numeral 10. Device 10 is formed of three separate elements that, when assembled, function as described and claimed. Device 10 includes an anchor 11 in the form of a double-eye member, a bracket 20 in the form of a complementary double-hook member and a shield 30 in the form of a plastic mortar catcher. Both the anchor 11 and bracket 20 are generally U-shaped, and are preferably formed of 3/16ths inch diameter galvanized steel wire.

Anchor 11 includes a pair of spaced-apart arms 12 and 13 integrally formed with a bridging arch member 14. The free end of the two arms 12 and 13 have first attachment means in the form of respective eyelets 15, 16. Anchor 11 thus has both a lengthwise and widthwise dimension and is intended to be imbedded and locked into a mortar joint with the eyelets 15 and 16 extending into the cavity between inner and outer walls of a construction, as further described and shown below. In a preferred embodiment, the arms 15 and 16 may vary in length depending on the width of the cavity, but are typically between 2¾ in. and 4¾ in. long, with the bridging arch 14 being either 2¾ in. or 4⅛ in. long. This anchor 11 is a prior art element sold by applicant as part of a system for tying masonry to masonry and is part of a "adjustable rectangular tie" or "hook-and-eye" reinforcing system.

Other types of anchors may be used, as, for example, an RJ 711 veneer anchor sold by applicant, as appropriate for the type of inner wall to which the anchor will be attached.

Bracket 20 has two spaced-apart arms 21 and 22 integrally formed with a bridging arch member 23. The free end of the two arms 21 and 22 have second attachment means in the form of respective downwardly-extending hooks 24 and 25 formed by downwardly bending arms 21 and 22, as shown in the drawings. The arms 21 and 22 have slight upward bends 26, 27 at the junction with the hooks 25 and 26 in order that the anchor and bracket will reside in the same plane when joined and in place. Hooks 24 and 25 also have bends 28, 29 which assist in retaining the hooks 24, 25 in the respective eyelets 15 and 16. As best shown in FIG. 1, the arms 21 and 22 diverge away from the hooks 24 and 25 and towards the bridging arch 23.

In a preferred embodiment, the arms 21 and 22 of bracket 20 may vary in length depending on the width of the cavity, but are typically between 3¼ in. and 5¼ in. long. The bridging arch 23 is preferably 4⅛ in. long, and the hooks 24 and 25 are 2¼ in. apart. This bracket 20 is similar to a prior art element manufactured and sold by applicant as part of a system for tying masonry to masonry and is part of a "adjustable rectangular tie." This prior art element does not have diverging arms, as disclosed in this application.

Figure 4:
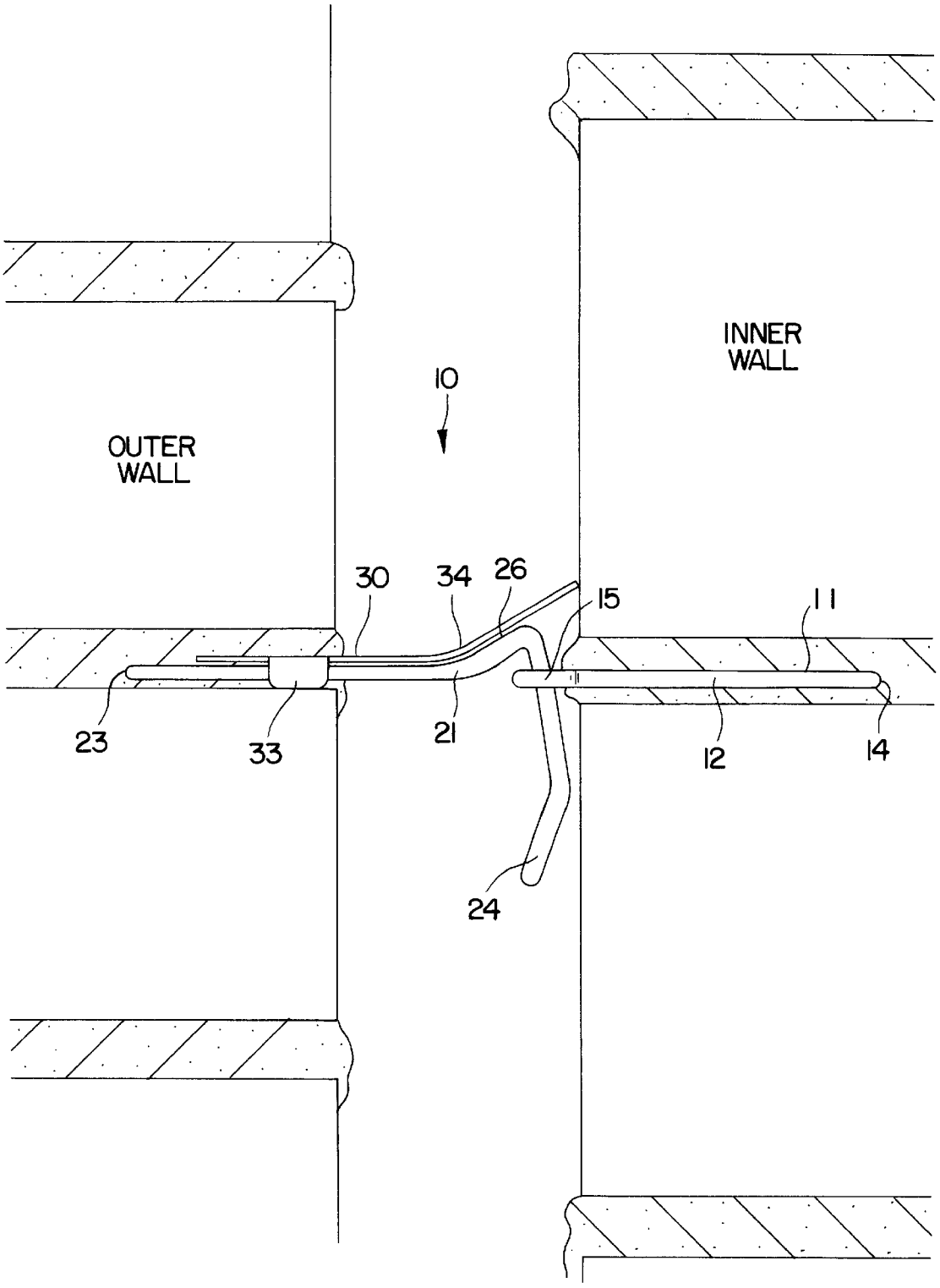
FIG. 4 is a side elevation in partial cross-section of the device shown in FIG. 1.

As is also shown in FIG. 1, the mortar shield 30 is formed of a strip of plastic approximately 1/10 in. thick, although the thickness is not critical as long as the strip of material is sufficiently rigid to support an accumulation of mortar. Shield 30 is preferably 12 inches long 3 in. wide, and includes a pair of spaced-apart, 4½ in. long and 1/4 in. wide elongate openings 31 and 32 defining a web portion 33 between them. A crease 34 extends along the length of the shield 30 approximately 1 in. from one side and provides additional rigidity against downward deflection of the ends of the shield under load, and permits the shield 30 to be deformed under pressure against the adjacent masonry wall, as shown in FIG. 4. The shield 30 may be any width and length suitable for the type of wall system with which it is being utilized, and may be constructed of any suitable material, such as numerous types of plastic or metal. The shield by be formed of solid material, as shown, or from foraminous material, such as expanded metal, mesh or screen. The shield may be formed by any of several means, such as die-stamp cutting sheet material or injection molding. Preferably, the web portion 33 is either stretched or formed to be longer than the openings 31 and 32 so that the shield is not excessively deformed when the bracket 20 is positioned therein.

Figure 2:
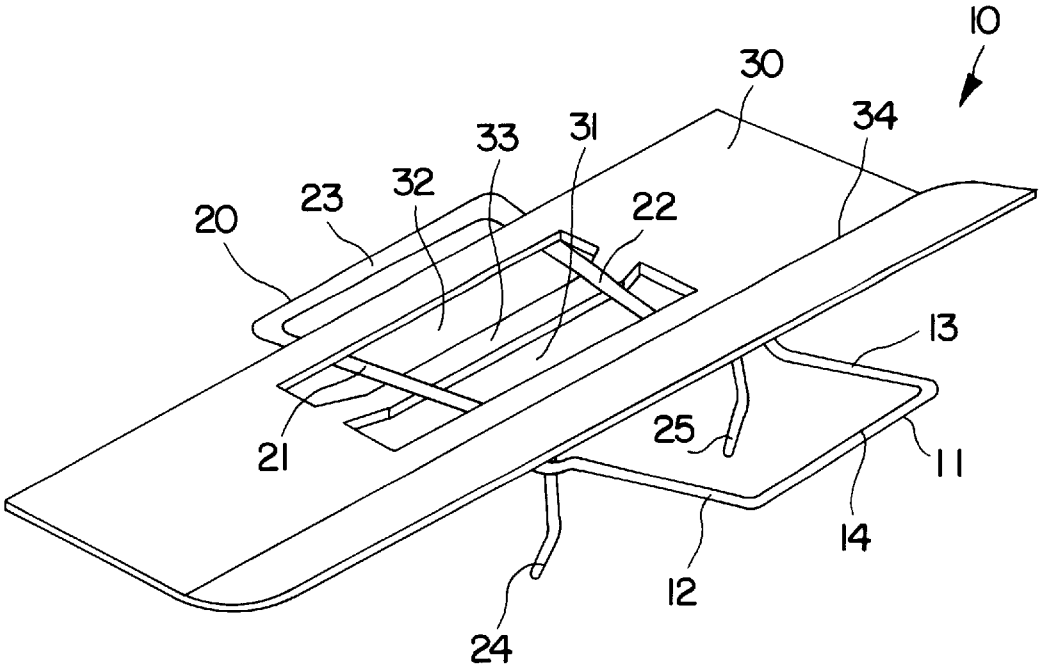
FIG. 2 is an assembled view of the device shown in FIG. 1.

As is shown in FIG. 2, the assembly of the mortar collecting device is completed by positioning the shield 30 onto the bracket 20. This is accomplished by inserting the bridging arch 23 end of the bracket into opening 31 from the bottom, extending the bracket 20 across the top of the web 33, extending the bracket 20 into the opening 32 from top to bottom, and finally further extending the bracket 20 until the bridging arch 23 extends beyond the side of the shield 30 nearest opening 32. Ordinarily, this is done before the hooks 24, 25 of the bracket 20 are inserted into the eyelets 15, 16 of the anchor 11.

Figure 3:
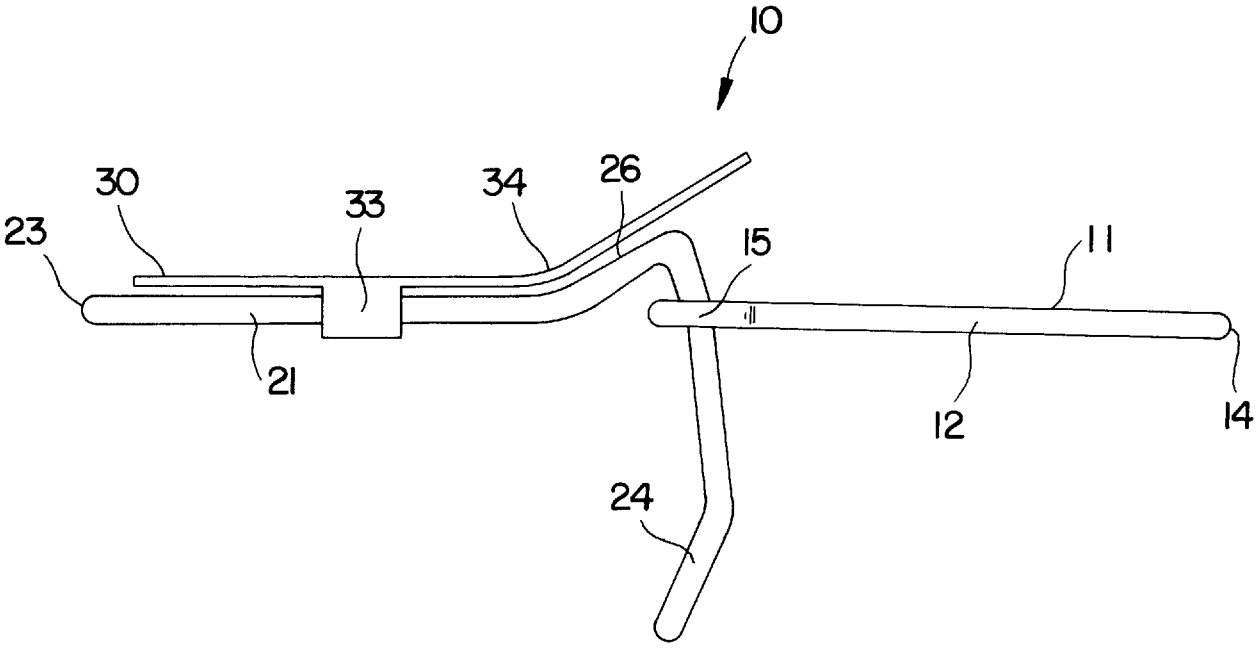
FIG. 3 is a side elevation of the device shown in FIG. 1.

The fully assembled mortar collecting device 10 is shown in FIGS. 3 and 4. Anchor 11 is embedded in a mortar joint of the inner masonry wall with the eyelets 15 and 16 protruding into the cavity between the inner wall and the outer wall. The mortar collecting device 10 is positioned so that mortar that would otherwise fall into the bottom of the cavity and block the weep-hole is caught and accumulated on the shield 30. More particularly, the mortar collecting devices 10 are typically positioned in the second and fourth courses of a masonry wall and staggered laterally so that no two mortar collecting devices 10 are vertically aligned. This staggered arrangement is normally achieved automatically as a result of the conventional manner of positioning hook-and-eye anchors for other purposes.

The bridging arch 23 and adjacent portions of arms 21 and 22 extend entirely across the cavity and are embedded in an opposing mortar joint of the outer masonry wall, as shown. Note that a portion of the shield 30 is also embedded in the mortar joint of the outer masonry wall. The opposing side of the shield 30 is pressed up against the inner masonry wall. Thus, the entire width of the cavity above the weep-hole is completely protected from side-to-side.

In accordance with prior art practice (see, for example, FIG. 2 of U.S. Pat. No. 4,852,320), the height of the mortar collecting devices 10 is staggered in order to provide lateral ventilation and to prevent a cavity-blocking accumulation of mortar along a single course of blocks. The arrangement shown in FIG. 4 not only provides for collection of mortar which would otherwise block drainage of water through weep-holes, but also provides a tie between the inner and outer walls. The deformation of the shield 30 is accomplished by passing the bracket 20 through the openings 31 and 32.

A mortar collection device is described above. Various details of the invention may be changed without departing from its scope. Furthermore, the foregoing description of the preferred embodiment of the invention and the best mode for practicing the invention are provided for the purpose of illustration only and not for the purpose of limitation—the invention being defined by the claims.

I claim:

1. A mortar collecting device for being positioned in a cavity between first and second spaced-apart walls wherein at least one of the walls is a masonry wall, comprising:

(a) an anchor for being attached to one of the walls;

(b) first attachment means carried by the anchor for being positioned in the cavity between the first and second walls;

(c) a bracket for being positioned at least partially in the cavity between the first and second walls;

(d) second attachment means carried by the bracket and cooperating with the first attachment means of the anchor for supporting the bracket; and (e) a shield for being carried and supported by the bracket in the cavity between the walls, the shield comprising:

(1) a deformable elongate sheet for being positioned on the bracket in the cavity and extending along a predetermined length of the cavity in contact with both of the walls to prevent mortar from accumulating in the bottom of the cavity and blocking weep-holes formed in the masonry wall; and (2) first and second spaced-apart elongate openings formed in the sheet and defining therebetween an elongate web, the bracket for being positioned through the openings with the sheet supporting the bracket on one side thereof and the web supporting the bracket on an opposing side thereof.

2. A mortar collecting device according to claim 1, wherein said anchor comprises a length of wire formed in a U-shape having both a lengthwise and widthwise dimension for being locked into a mortar joint of the masonry wall.

3. A mortar collecting device according to claim 1, wherein the first attachment means comprises at least one eyelet formed by a bend in the anchor.

4. A mortar collecting device according to claim 3, wherein the bracket comprises a length of wire.

5. A mortar collecting device according to claim 4, wherein the second attachment means comprises an elongate hook for being positioned into the eyelet.

6. A mortar collecting device according to claim 4, wherein the shield comprises plastic.

7. A mortar collecting device according to claim 6, wherein the shield includes a crease extending along the length thereof for permitting the shield to be deformed under pressure against one of the walls.

8. A mortar collecting device according to claim 1, wherein:

(a) the anchor comprises a U-shaped length of wire having a pair of elongate arms spaced-apart by a bridging arch member;

(b) the first attachment means comprises first and second eyelets formed on respective first and second free ends of the arms of the anchor;

(c) the bracket includes:

(1) first and second hooks defined by first and second bracket arms spaced-apart by a bracket arch member for being received in the eyelets of the anchor; and (2) the hooks being formed to extend generally downwardly when received in the eyelets.

9. A mortar collecting device according to claim 8, wherein the bracket arch member extends at substantially right angles to and diverges from the hooks.

10. A mortar collecting device for being positioned in a cavity between first and second spaced-apart walls masonry walls, comprising:

(a) an anchor for being embedded in a mortar joint of the first masonry wall;

(b) first attachment means carried by the anchor for being positioned in the cavity between the first and second walls;

(c) a generally U-shaped bracket for being positioned at least partially in the cavity between the first and second walls;

(d) second attachment means carried by the bracket and cooperating with the first attachment means of the anchor for supporting the bracket; and (e) a shield for being carried and supported by the bracket in the cavity between the walls, the shield comprising:

(1) a deformable elongate sheet for being positioned on the bracket in the cavity and extending along a predetermined length of the cavity in contact with both of the walls to prevent mortar from accumulating in the bottom of the cavity and blocking weepholes formed in the masonry wall; and (2) first and second spaced-apart elongate openings formed in the sheet and defining therebetween an elongate web, the bracket for being positioned through the openings with the sheet supporting the bracket on one side thereof and the web supporting the bracket on an opposing side thereof.

* * * * *